US008820409B2

(12) United States Patent
Lacy

(10) Patent No.: US 8,820,409 B2
(45) Date of Patent: Sep. 2, 2014

(54) SYSTEM FOR PROTECTING AGAINST UNDERSEA OIL SPILLS

(76) Inventor: Franklin R Lacy, Tampa, FL (US)

( * ) Notice: Subject to any disclaimer, the term of this patent is extended or adjusted under 35 U.S.C. 154(b) by 0 days.

(21) Appl. No.: 13/074,869

(22) Filed: Mar. 29, 2011

(65) Prior Publication Data

US 2012/0247784 A1 Oct. 4, 2012

(51) Int. Cl.
*E21B 34/04* (2006.01)
*E21B 43/01* (2006.01)

(52) U.S. Cl.
CPC ..... *E21B 43/0122* (2013.01)
USPC ..... 166/338; 166/363; 166/364; 166/367; 166/368

(58) Field of Classification Search
CPC ..... E21B 43/0122
USPC ..... 166/338, 344, 351, 352, 363, 364, 367, 166/368, 369, 372
See application file for complete search history.

(56) References Cited

U.S. PATENT DOCUMENTS

| | | | | |
|---|---|---|---|---|
| 3,602,299 | A * | 8/1971 | Mozic | 166/351 |
| 4,461,354 | A * | 7/1984 | Buras et al. | 166/343 |
| 4,531,860 | A * | 7/1985 | Barnett | 405/60 |
| 4,568,220 | A * | 2/1986 | Hickey | 405/60 |
| 8,016,030 | B1 * | 9/2011 | Prado Garcia | 166/75.13 |
| 8,025,103 | B1 * | 9/2011 | Wolinsky | 166/364 |
| 8,173,012 | B1 * | 5/2012 | Che | 210/170.05 |
| 2012/0160509 | A1 * | 6/2012 | Caldwell et al. | 166/363 |
| 2012/0186822 | A1 * | 7/2012 | Mahajan et al. | 166/364 |

* cited by examiner

*Primary Examiner* — James Sayre
(74) *Attorney, Agent, or Firm* — Clark A. Puntigam; Jensen & Puntigam, P.S.

(57) ABSTRACT

The system includes a containment housing with an open bottom which is configured to fit over an undersea oil well pipe which is spilling oil, the housing being lockable to a platform or ring surrounding the oil well pipe or positionable on the sea floor. A pipe is positioned internal of the housing into which the oil well pipe can be fitted, the vertical pipe being directed to or connectable to an evacuation pipe which extends to the surface of the sea, through which the oil from the well moves by means of an evacuation pump. The oil is pumped at a rate approximately at least as great as the rate of the oil spill. An infusion line and associated pump is connected to the chamber for pumping mud and/or cement and/or concrete into the chamber to stop and seal the spill and to ensure the housing remains positioned over the oil spill well pipe.

11 Claims, 2 Drawing Sheets

SYSTEM FOR PROTECTING AGAINST UNDERSEA OIL SPILLS

TECHNICAL FIELD

This invention relates generally to undersea oil well protection equipment, and more specifically concerns a system for containing/preventing undersea oil spills resulting from oil well blowouts/explosions.

BACKGROUND OF THE INVENTION

There is widespread recognition of the disastrous environmental effects of an oil well blowout or explosion, which typically results in a significant oil spill. One such explosion in the Gulf of Mexico resulted in hundreds of millions of dollars in environmental damage as well as significant loss of business revenue in the Gulf region.

Many systems and devices are known which attempt to contain and resolve oil well blowouts/explosions, typically by attempting to cap or seal the damaged well. However, none of these systems/devices have in fact proven to be effective, particularly with blowouts of deep undersea oil wells, as the Gulf spill in 2010 proved, spilling oil in huge quantities, unabated for months, even with continuous, and very expensive, attempts to contain the spill. Accordingly, there is a significant present and ongoing need for a reliable system which is capable of preventing and/or containing an oil spill resulting from failure of an oil well, such as might occur in a blowout, explosion or other cause.

DISCLOSURE OF THE INVENTION

Accordingly, the system for containing an undersea oil well spill comprises: a containment housing having an open bottom configured to fit over an oil well spill pipe through which effluent comprising oil and/or gas is spilled into the sea, wherein the housing is lockable or sealable to a platform or ring surrounding the oil well pipe or is positioned on the sea floor; a pipe positioned internally of the housing, into which the oil well pipe can be fitted, wherein the internal pipe is connectable to an evacuation pipe which extends from the containment housing to the surface of the sea; an evacuation pump for evacuating the oil spilled from the well at a rate approximately at least as great as the rate of the oil spillage from the oil well spill pipe; and an infusion line, and associated pump, connected to the housing for pumping selected sealing material into the chamber, thereby sealing around the spill pipe with the housing, while allowing oil or other effluent to be pumped to the surface through the internal pipe and the evacuation pipe.

BRIEF DESCRIPTION OF THE DRAWINGS

FIG. 2A is a simplified view showing a new well head on top of an existing housing.

BEST MODE FOR CARRYING OUT THE INVENTION

Figure 1:
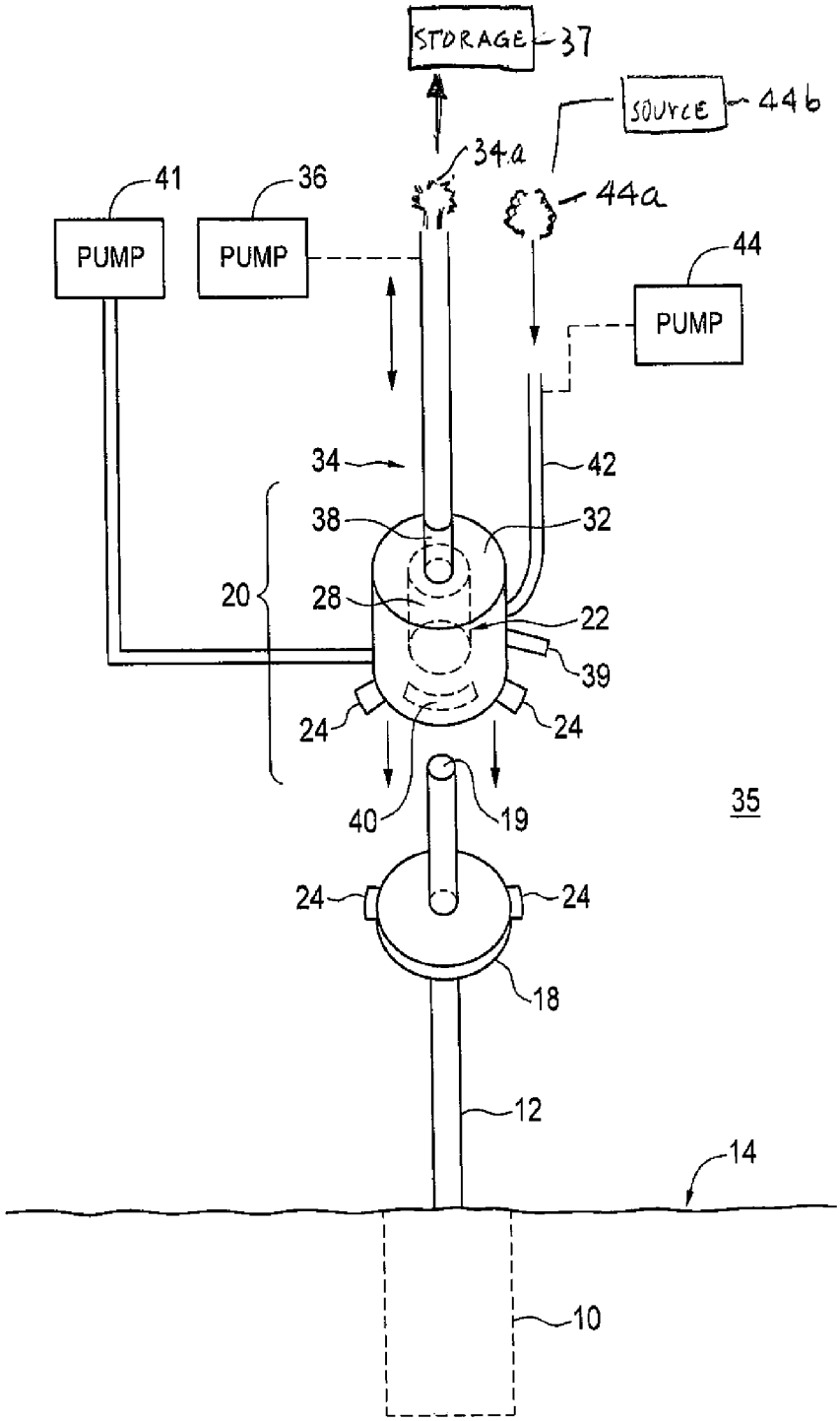
FIG. 1 is a schematic view showing the oil spill prevention/containing system of the present invention.

Referring now to FIG. 1, a deep sea oil well is shown representationally at 10 for a source of oil in the sea floor. It should be understood that such an oil well includes a substantial structure, from the sea floor and below to the surface. Such a structure is conventional and is thus not shown in FIG. 1. It should also be understood that oil well 10 refers to any oil well, typically, but not necessarily, a deep sea oil well, such as is present in the Gulf coast region of the United States, i.e. the Gulf of Mexico. Additional deep sea oil wells are found for example in the North Sea, the Atlantic Ocean off the coast of Brazil, the Arctic Ocean and in other locations.

Extending from oil well 10, i.e. the source of oil, in FIG. 1 is a well head pipe 12 (shown broken off). The broken pipe, either partially ruptured or completely severed, is representative of the result of a blow-out or explosion in which the above sea floor structure of the well system is separated from the well head pipe, through which oil from the well is moved to the surface. Following the accident, effluent, in the form of oil or oil and gas proceeds from pipe 12 at high pressure and in great volume. The well head pipe 12 may have various arrangements and configurations. Typically, pipe 12 will be made of steel and will be anywhere from 2 to 18 inches in diameter. The well head pipe 12 extends upwardly from the sea floor, generally indicated at 14.

In one embodiment of applicant's invention, an oil impervious safety platform or ring 18 is secured to the exterior surface of the well head pipe and extends outwardly therefrom. The dimensions of this platform can vary, but in one example it is circular, approximately 36 inches in diameter, 4 inches thick and is made from concrete. Alternatively, a much smaller diameter platform or ring can be used with a horizontal dimension decreasing to 1 inch or even less. Safety platform or ring 18 can be used with an existing, functioning oil well, applied to with oil wells as they are manufactured and put into place, or positioned with the well pipe as part of a containment effort after there has been a blowout or explosion of the oil well. Alternatively, platform or ring 18 can be made from joined pieces of steel. In an alternative embodiment, a safety platform is not used, as discussed in more detail below.

The containment system, shown generally at 20, includes a chamber 22, typically cylindrical, which has an open bottom. Chamber 22 can be of various sizes. In one example, the diameter of the chamber 20 will match the diameter of safety platform 18. The height of the chamber can also vary, but in one example will be approximately 4 feet, with an inside diameter in the range of 1-4 feet. Chamber 22 should have sufficient internal volume so that it will enclose the well pipe 12 and its height will extend above the end of the oil well pipe by approximately 1 foot or more. When platform 18 is in place, there is usually a locking mechanism provided therewith, shown generally at 24, which locks or otherwise joins chamber 22 physically to platform or ring 18.

Positioned internally of chamber 22 is a vertical pipe 28 which is typically, but not necessarily, cylindrical. Vertical pipe 28 has a diameter large enough so that the distal, i.e. broken off, end 19 of the well head pipe can fit within vertical pipe 28, such that when the lower edge of chamber 22 is positioned into place against platform 18, the distal end of the well head pipe 12 is positioned within the vertical pipe 28. Usually there will be some space, e.g. 1 inch between the internal dimension of the lower portion of vertical pipe 28 and the external dimension of well head pipe 12.

Still referring to FIG. 1, extending upwardly from the upper surface 32 of chamber 22 and in fluid communication with vertical pipe 28 is an effluent evacuation pipe 34. The effluent evacuation pipe is typically made from steel and, for example, will have a diameter of approximately 4-14 inches, although this can also vary. The effluent evacuation pipe 34 extends upwardly through sea 35, typically to the surface of the sea, where it may connect with a surface vessel 37 to receive the effluent 34A, i.e. the oil and gas. Alternatively, the effluent can be burned away at the surface of the sea, at the free end of pipe 34. The containment system includes pump (s) 36 operating on evacuation pipe 34, moving the effluent material in the evacuation pipe to the surface, as well as a valve 38, typically located on the top of chamber 22 for closing the evacuation pipe completely or alternatively controlling the amount of effluent moving through the evacuation pipe.

An infusion pipe 42 connects chamber 22 to the surface. A pump 44 is connected to the infusion pipe 42. The infusion pipe and associated pump 44 are designed to pump sealing material 44A such as mud or concrete or a combination thereof from the surface down into the interior of chamber 22. Pumping mud/concrete into the chamber will help to ensure the physical sealing of the chamber 22 and the stability of the chamber on platform 18 or on the sea floor 14, in the event that there is no platform 18, which is an alternative embodiment of the present system. Chamber 22 will also include in this embodiment a heating assembly 40 as part of the containment system, for warming the interior of the chamber between vertical pipe 28 through which effluent passes and the internal wall of the chamber 22. In one embodiment, a pump 41 is used to circulate heated liquid from the surface into and then out of chamber 22, heating the interior of chamber 22 as well as pipe 28 therein, to prevent effluent gasses from freezing. Pipe 34 can also be heated in similar fashion.

When a blowout or explosion occurs, an open well head pipe 12 results, through which oil and gas from well 10 escapes at considerable pressure and resulting high volume. The containment system 20 is lowered until the lower edge thereof mates with platform or ring 18 which has been installed following the blowout or which is in place as part of the original system. Alternatively, the chamber 22 is lowered to the sea floor 14 if there is not platform 18. If the lower edge of chamber 22 mates with a platform, such as platform or ring 18, the chamber is locked to the platform by locking members 24. In this position, the upper portion of well head pipe 12 is positioned within internal vertical pipe 28 which is in fluid communication with evacuation pipe 34.

During this operation and continuing, pump 36 is operated, moving effluent up through vertical pipe 28 and into the evacuation pipe 34, from where it moves to the surface. Initially, some sea water will typically be pumped with the effluent. The pump operates at a rapid rate, equal to or approximately equal to the rate of effluent escape from the well. As a result, there is no significant build up of pressure of the escaping effluent and gas, i.e. the pressure is approximately equal to or less than the pressure surrounding the spilling oil, no greater than the pressure surrounding the spilling oil, the normal water pressure at the depth of the well head. Hence, the effects of pressure are resolved, i.e. neutralized, by the present system, eliminating one of the significant containment issues of a deep sea oil well blowout/explosion.

The heating system, which in one embodiment comprises a heating coil or other element 40, or in another embodiment includes heated liquids being pumped from the surface, is also operated, which results in the environment within the chamber, i.e. the interior of the chamber, being warmed to at least reach or approach the temperature of the effluent oil and/or gas, thereby providing the advantage of preventing icing within the housing, another problem with many existing containment systems.

Creating an approximately neutral or negative pressure environment within chamber 22 allows mud and/or cement or concrete or a combination thereof to be pumped from the surface into the chamber/housing 22 through infusion pipe 42 by means of pump 44. This material is pumped into the housing while the effluent material continues to be pumped through vertical pipe 28 and evacuation pipe 34 to the surface. The mud/cement material pumped into the housing will set up, sealing chamber 22 from leaking and adding sufficient weight, adhesion and reducing the surface area subjected to effluent pressure to prevent chamber 22 from moving away from the oil spill well pipe 12, regardless of the internal effluent pressure. Most of the interior surface of the chamber will be protected from the pressure of the escaping oil when the effluent flow is sealed off. At this point, the containment of the oil spill is basically complete. Further spillage is prevented.

The well can now be sealed off, by pumping a combination of mud and/or cement down evacuation pipe 34 and vertical pipe 28 into the well. Further pumping of oil from the well is now prevented, and the well is permanently sealed within the original well pipe.

Alternatively, a new well head 29, with new well head equipment, including a blowout preventer, can be positioned on top of the housing 22, resulting in the possibility of continuing the pumping of oil from well 10.

Figure 2:
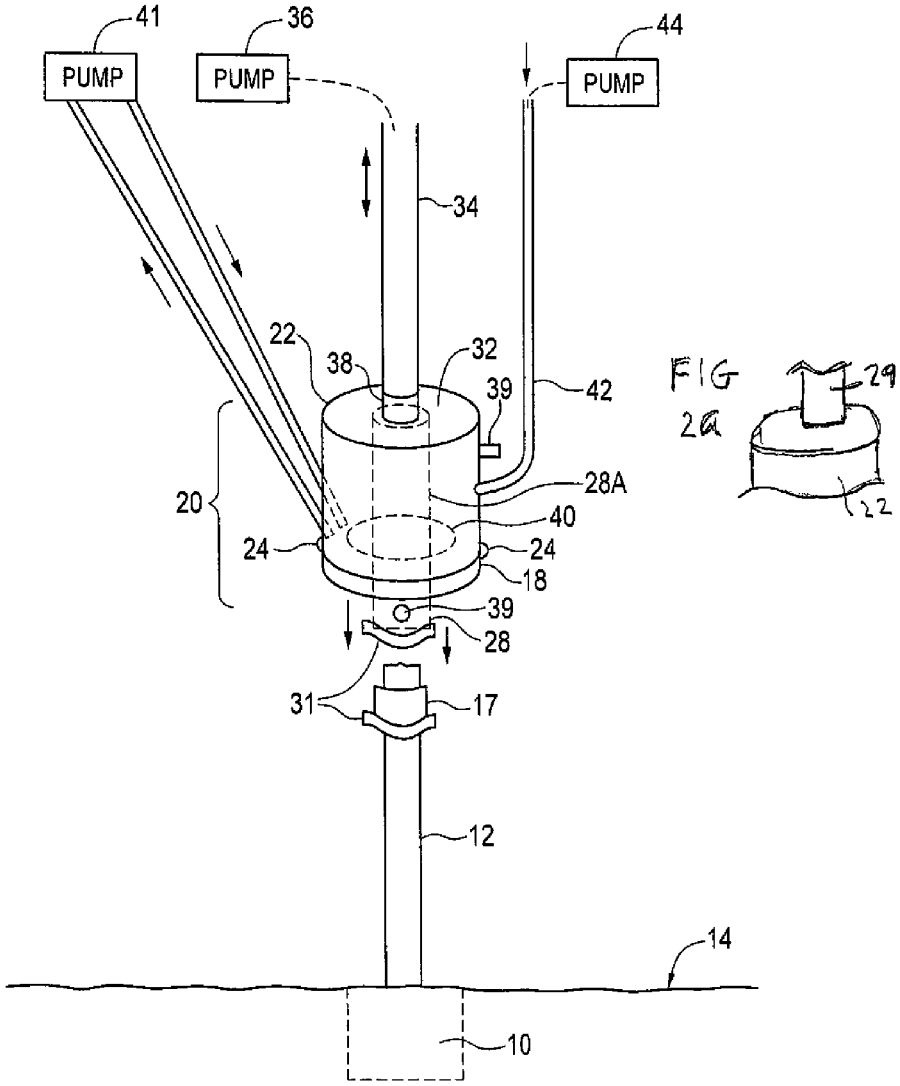
FIG. 2 is a schematic view of an alternative system.

In an alternative embodiment, shown in FIG. 2, conventional well head equipment, such as a blowout preventer and/or valve 28A in combination with vertical pipe 28, can be positioned within chamber 22 to permit reactivation of the well after the oil spill is stopped. In this situation, chamber 22 would only be filled with driller's mud (by pump 44 through pipe 42) so that the chamber can be removed. In this embodiment, a portion of the vertical pipe 28 inside chamber 22 would extend down past the bottom of the chamber and lock onto the well pipe 12 with a sealing ring 17 located between the well pipe 12 and the lower end of the vertical pipe 28. In this embodiment, the platform or ring 18 is mounted to the vertical pipe 28 with chamber 22 locked to it, while the chamber is above the surface of the water prior to installation on the well pipe 12.

The distal end of well head pipe 12 is positioned within the vertical pipe and clamped by a clamping assembly 31 at or near the sealing ring. Typically, there will be some small amount of space, e.g. 1 inch, between the internal dimension of the lower portion of the vertical pipe 28 and the external dimension of well head pipe 12. This is enough room to clear the well head pipe and allow clamping. In this embodiment, the vertical pipe 28 will have a reduced diameter so that a blowout preventer 19 can be positioned within chamber 22. In this embodiment, as noted above, platform or ring 18 can be pre-mounted onto and just above the lower end of vertical pipe 28.

In addition, open valves 39 can be added to chamber 22 in FIG. 1 and/or the lower part of pipe 28 in FIG. 2, the valves to be open during installation of the containment system on or around well pipe 12. The valves 39 can be closed after sufficient pumping of the effluent to the surface has been established. This reduces the possibility of back pressure on the chamber when the chamber 22 or pipe 28 is locked to the well platform or ring. Some pumping of mud and/or concrete into chamber 22 or around vertical pipe 28 can be done to seal the mating members. Pressure and temperature monitors can also be included in the chamber.

One of the advantages of the present system is that it can be quickly put into place and operated to produce the desired results of rapid and reliable containment of the oil spill, generally minimizing the damage caused by the spill.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A system for containing an undersea oil well spill, comprising:

a containment housing having an open bottom configured to fit over an oil well spill pipe through which effluent comprising oil and/or gas is spilled into the sea, wherein the housing is lockable or sealable to a platform or ring surrounding the oil well pipe or is positioned on the sea floor;

a pipe positioned internally of the housing, into which oil from the oil well pipe moves in operation, wherein the internal pipe is in fluid communication with an evacuation pipe which extends from the containment housing;

an evacuation pump for evacuating the oil spilled from the well at a rate approximately at least as great as the rate of the oil spillage from the oil well spill pipe creating an approximately equal or negative pressure environment within the housing, such that there is no buildup of pressure of the escaping effluent and gas within the housing; and an infusion line, and associated pump, connected to the housing for pumping selected sealing material into the housing, thereby sealing around the spill pipe within the housing and sealing the housing from leaking, providing adhesion and reducing surface area subjected to effluent pressure so as to prevent the housing from moving away from the spill pipe, while allowing oil or other effluent to continue to be pumped out of the housing through the internal pipe and the evacuation pipe.

2. The system of claim 1, including a heating assembly positioned within or adjacent to the housing for heating the interior of the housing and/or the evacuation pipe to prevent icing therein as effluent moves through the internal pipe within the housing and is thereafter pumped to the surface.

3. The system of claim 1, wherein the evacuation pipe extends to a storage vessel on the surface of the sea for storage of the effluent.

4. The system of claim 1, wherein the evacuation pipe extends to the surface of the sea where the effluent is burned off as it reaches the end of the evacuation pipe.

5. The system of claim 1, including a valve positioned on or adjacent to the housing for closing off the evacuation pipe, thereby preventing or decreasing movement of the effluent through the evacuation pipe.

6. The system of claim 1, wherein the sealing material pumped into the housing through the infusion line is mud or cement and/or concrete or a combination thereof.

7. The system of claim 1, including a source of mud and/or cement and/or concrete connectable to the evacuation pipe for sealing the oil well.

8. The system of claim 1, wherein the housing is adapted to permit connection of a new well head so that oil can continue to be pumped from the oil well.

9. The system of claim 1, wherein the housing is adapted for locking onto the internal pipe and wherein the internal pipe extends below the housing to lock onto a member mounted to the oil well pipe.

10. The system of claim 9, including a blowout preventer assembly mounted within the housing as part of the internal pipe, wherein the sealing material is such as to permit the housing to be removed after the spill has been stopped.

11. The system of claim 1, wherein the evacuation pump is a two-way pump and for pumping a combination of mud and/or cement down the evacuation pipe into the well following sealing of the housing.

* * * * *